US007975420B2

(12) United States Patent
Pestana

(10) Patent No.: US 7,975,420 B2
(45) Date of Patent: Jul. 12, 2011

(54) MULTI-CLIP MAGAZINE ASSEMBLY FOR RIFLES

(76) Inventor: Alan D. Pestana, Deer Park, WA (US)

( * ) Notice: Subject to any disclaimer, the term of this patent is extended or adjusted under 35 U.S.C. 154(b) by 77 days.

(21) Appl. No.: 12/591,000

(22) Filed: Nov. 17, 2009

(65) Prior Publication Data

US 2011/0113668 A1 May 19, 2011

(51) Int. Cl.
*F41A 15/00* (2006.01)

(52) U.S. Cl. ..... 42/90; 42/49.01; 42/50; 224/931; 89/34

(58) Field of Classification Search ..... 42/90, 7–49.1; 89/34; 206/3; 224/931; D22/108
See application file for complete search history.

(56) References Cited

U.S. PATENT DOCUMENTS

| | | | | | |
|---|---|---|---|---|---|
| 2,289,067 | A | | 7/1942 | Owsley | |
| 3,191,332 | A | | 6/1965 | Ardolino | |
| 3,623,256 | A | * | 11/1971 | Shiplee, III | 42/50 |
| 3,938,717 | A | * | 2/1976 | Theodore | 224/183 |
| 4,447,976 | A | | 5/1984 | Cooper | |
| 4,484,403 | A | * | 11/1984 | Schwaller | 42/50 |
| 4,484,404 | A | * | 11/1984 | Johnson | 42/90 |
| 4,628,627 | A | | 12/1986 | Johnson | |
| 4,685,238 | A | | 8/1987 | Schoepflin | |
| 5,279,059 | A | | 1/1994 | Howard | |
| D362,896 | S | * | 10/1995 | Hasselbusch | D22/108 |
| D375,778 | S | * | 11/1996 | Hasselbusch | D22/116 |
| 5,615,506 | A | | 4/1997 | Jackson et al. | |
| 5,676,241 | A | * | 10/1997 | Degoix et al. | 206/3 |
| 6,202,908 | B1 | * | 3/2001 | Groover | 224/239 |
| 6,502,495 | B1 | * | 1/2003 | Beary | 89/34 |
| 6,668,479 | B1 | | 12/2003 | Obong | |
| D502,524 | S | * | 3/2005 | Fisher et al. | D22/108 |
| 7,073,285 | B2 | | 7/2006 | Obong | |
| 7,194,837 | B2 | | 3/2007 | Obong | |
| D588,227 | S | * | 3/2009 | Swenson et al. | D22/108 |
| 7,497,043 | B2 | * | 3/2009 | Clifton et al. | 42/49.01 |
| 7,562,482 | B1 | * | 7/2009 | Johnson | 42/90 |
| 7,614,534 | B2 | * | 11/2009 | Veo et al. | 224/196 |
| 2006/0242877 | A1 | * | 11/2006 | Clifton et al. | 42/49.01 |

* cited by examiner

*Primary Examiner* — Michelle Clement
(74) *Attorney, Agent, or Firm* — Todd N. Hathaway

(57) ABSTRACT

An apparatus for detachably joining together a plurality of individual ammunition magazines to form a multiple magazine assembly in which the individual magazines are alternately insertable into the firearm. The apparatus includes a connector block with outwardly-directed mounting faces having locating features that form a sliding engagement with recesses in the bases of the magazines. A coupling piece mounts to an end of the connector block and includes projecting tab portions that enter cooperating recesses in the forward sides of the magazine so as to hold the magazines in place on the mounting faces of the connector block. An adjuster screw can be loosened to withdraw the retaining tabs so that the individual magazines can be placed or removed from the mounting faces of the connector block, and then tightened to hold the magazines firmly against the connector block to complete the assembly. The connector block may be triangular with mounting faces for three magazines. The connector block may be triangular with mounting faces for three magazines.

18 Claims, 5 Drawing Sheets

MULTI-CLIP MAGAZINE ASSEMBLY FOR RIFLES

BACKGROUND a. Field of the Invention

The present invention relates generally to ammunition magazines for use in firearms, and, more particularly, to an apparatus in which a plurality of individual magazines is mounted together to form a multiple magazine assembly in which the individual magazines are alternatively receivable in the firearm.

b. Related Art

Many firearms utilize magazines to hold a supply of ammunition. One common type is a detachable magazine that can be removed from the firearm to be loaded, and then reinserted in a well or other opening leading to the receiver of the gun. Detachable magazines have the particular advantage that multiple magazines can be loaded ahead of time and then used one after another in a rapid fashion when needed; the convenience of having multiple loaded magazines on hand is offset, however, by the need to somehow carry them, for example, in a pouch or pocket, for example.

One category of firearms commonly using detachable magazines is semiautomatic rifles. A particular benefit of semiautomatic rifles is the rapid rate of fire made possible by the auto-loading action, and this advantage is complemented by the rapid-change nature of detachable magazines. This combination of features is notably successful in the case of .22 rimfire semiautomatic rifles, which enjoy the added advantage of comparatively inexpensive ammunition. One non-limiting example of such a rifle is the Ruger Model 10/22™.

Over the years, many attempts have been made to give semiautomatic rifles increased magazine capacity. The most basic approach has been to simply increase the size of the magazine, as exemplified by long vertical/curved magazines (e.g., "banana clips") and large drum magazines. This approach suffers the obvious problems of bulk and weight, but perhaps the most significant drawback has been the difficulty in achieving reliable feeding of the ammunition, owing in part to the use of long springs, ramps and other mechanisms generally inherent in such devices. Many of the feeding problems also stem from the fact that the geometry of the cartridges is based on their principal purpose of functioning within the chamber/barrel of the firearm rather than being optimized for being fed in long rows or columns; this is particularly problematic in case of .22 rimfire cartridges (e.g., .22 long rifle, .22 long, .22 short), which are old designs that originated long before the advent of semiautomatic rifles. The intractable nature of this problem is illustrated by the ongoing struggle with reliable feeding encountered with long "banana" clips and similar magazines presently marketed for .22 semiautomatic rifles.

As an alternative to simply larger/longer magazines, some efforts have been made at joining a plurality of magazines together in a composite structure. A basic approach has been to clamp or similarly connect a plurality of otherwise standard magazines end-to-end or side-to-side so that the magazines can be inverted or shifted side-to-side to feed a fresh supply of rounds into the firearm; examples of efforts in this vein are shown in U.S. Pat. Nos. 7,194,837; 7,668,479; 5,279,059; 4,685,238; 4,484,403; 3,191,333; and 2,289,067. As a group, such devices tend to create excessively bulky projections, to the point of rendering the rifle unwieldy, as well as being susceptible to separation and/or damage during use in the field. A related approach is illustrated in U.S. Pat. No. 5,615,506, in which a plurality of long, curved, somewhat "banana-shaped" clips are joined together by cooperating external lugs and grooves, which offers the advantage of high capacity but which creates a large, star-shaped mass below the rifle that is bulky and subject to being struck against obstructions while being carried; also, a reliance on an elongate clip mechanism renders the device susceptible to potential feeding problems.

A notable advantage of the Ruger Model 10/22™ (and certain other rifles) in this regard is the use of a rotary drum mechanism within the detachable magazine, which combines the advantages of compactness and extremely reliable feeding of cartridges.

Due to the excellence of its design, many or most Ruger 10/22™ shooters have acquired multiple factory magazines to go with their rifle or rifles. The device shown in U.S. Pat. No. 4,447,976 represents an attempt to capitalize on this situation, using two-sided and four-sided spacer-shaped mounts to which multiple units of the standard, rotary Ruger 10/22™ magazine are glued. Although successful to the extent of allowing multiple stock magazines to be used as a group, a very serious drawback of the apparatus shown in U.S. Pat. No. 4,447,976 is that once glued together the magazines cannot be removed to be replaced or used individually. For example, in the event that one of the rotary magazines become damaged, it cannot be removed, and so the serviceable magazines must remain connected to the defective unit for the duration; this is a significant problem, since the original magazines are not inexpensive, and an assembly containing four of the units represents a significant investment for the shooter.

Accordingly, there exists a need for an apparatus for joining together multiple ammunition magazines to form an assembly in which the individual magazines are alternately insertable into the firearm, while keeping the assembly compact and avoiding excessive bulk and projections that would encumber use of the firearm. Furthermore, there exists a need for such an apparatus that is able to make use of multiple original equipment-type magazines. Still further, there exists a need for such an apparatus that is able to use original equipment rotary-type detachable magazines, so as to avoid the feeding problems common with banana-type magazines and other magazines in which long stacks or rows of cartridges are advanced in a generally linear direction. Still further, there exists a need for an apparatus in which one or more of the individual magazines can be removed if necessary or desired, in order to effect a disassembly or to replace a damaged or otherwise inoperative magazine in the assembly. Still further, there exists a need for such an apparatus in which the components are economical to manufacture and durable and long-lasting in use.

SUMMARY OF THE INVENTION

The present invention has solved the problems noted above, and is an apparatus for detachably joining together a plurality of individual ammunition magazines to form a multiple magazine assembly in which the individual magazines are alternately insertable into a firearm.

In the broad aspect, the apparatus comprises: (a) a connector member having a plurality of mounting portions, each of the mounting portions having at least one locating feature that is detachably receivable in a base recess of the individual magazines, (b) a coupling member having a plurality of connector portions, each of the connector portions having at least one retaining feature that is detachable receivable in a forward recess of the individual magazines, and (c) means for selectively inserting the connector portions of the coupling member into the forward recesses of the individual magazines with the magazines received on the mounting portions, so as to detachably retain the magazines on the connector member to form the multiple magazine assembly.

The at least one locating feature of each of the mounting portions on the connector member may comprise first and second outside wall surfaces that are spaced apart laterally so as to fit within and engage first and second side wall surfaces of the base recesses of the individual magazines so as to hold the magazines against lateral movement relative to the connector member. The at least one locating feature of each of the mounting portions may also comprise forward and rearward outside wall surfaces that are spaced apart longitudinally so as to fit within and engage forward and rearward wall surfaces of the base recesses of the individual magazines so as to hold the magazines against longitudinal movement relative to the connector member. The at least one locating feature may further comprise first and second outwardly-projecting locating ribs, the first and second locating ribs having the outside wall surfaces formed on outwardly-facing sides thereof.

The at least one retaining feature of the connector portions of the coupling member may comprise a retaining tab that projects from the connector portion so as to extend into the forward recess of the individual magazine to be positioned above a forwardly projecting ledge portion located therein.

The connector member may comprise a connector block having a plurality of mounting positions at spaced locations about sides thereof, and the coupling member may comprise an end plate that is mounted to an end of the connector block. The mounting positions may be at radially-spaced locations about the sides of a connector block, and in a preferred embodiment there may be three mounting portions at equidistant radially-spaced locations about the connector block, for holding the three of the individual magazines in the assembly.

The connector portions of the coupling member may comprise radially-extending flange portions of the coupling plate, each of the flange portions having a retaining tab located proximate an outer end thereof.

The means for selectively inserting the connector portions of the coupling member into the forward recesses of the individual magazines may comprise coaxially aligned bores formed in the connector block and a coupling plate, and a screw member that is received in the coaxially aligned bores so that in response to tightening of the screw member the coupling plate having connector portions thereon is translated towards the connector block having the mounting portions thereon.

In a preferred embodiment, the apparatus comprises: (a) a connector member, comprising a connector block having forward and rearward ends and a perimeter, an axial bore extended between the forward and rearward ends of the connector block, and a plurality of outwardly directed mounting faces formed at radially-spaced locations about the perimeter of the connector block, each of the mounting faces comprising at least one raised base portion that is slidingly receivable in an upwardly extending recess in the base end of one of the individual magazines, the base portion having front, rear and side walls spaced apart so as to form a sliding interft with the walls of the recess, and first and second substantially parallel receiving ridges projecting outwardly proximate longitudinal side edges of the mounting face for being received in the upwardly-extending recess in the base of one of the individual magazines, the locating ridges having outside surfaces that are spaced apart so as to form an interfit with the side walls of the recess so as to hold the individual magazine against moving laterally on the mounting face; and a coupling member comprising an end plate mounted at the forward end of the connector block and having forward and rearward ends and a perimeter, an axial bore extending between the forward and rearward ends of the end plate in coaxial alignment with the bore of the connector block, a plurality of connector portions formed at radially-spaced locations about the perimeter of the end plate that correspond to the locations of the mounting faces of the connector block, each of the connector portions comprising a connector flange extending outwardly from the axial bore, and a retaining tab projecting rearwardly proximate an outer end of the connector flange for being received in a rearwardly extending recess in the forward side of one of the individual magazines, the retaining tab having a lower surface that forms an interfit with an upper surface of the ledge portion of the forwardly-extending recess so as to hold the individual magazine from moving outwardly relative to the connector portion; and an adjustment screw that is received in the coaxially aligned bores of the connector block and the end plate, the adjustment screw being selectively adjustable to translate the end plate between a forward position in which the coupling plate is spaced from the connector block so that the retaining tabs thereon are withdrawn from the recesses in the forward sides of individual magazines so as to allow the magazines to be removed from or placed on the mounting faces, to a rearward position in which the coupling plate is located proximate the connector block so that the retaining tabs thereon are inserted into the recesses in the forward sides of the individual magazines so as to secure the individual magazines in place on the mounting faces of the connector block.

These and other features and advantages of the present invention will be more fully understood and appreciated from a reading of the following detailed description with reference to the accompanying drawings.

DETAILED DESCRIPTION

Figure 1:
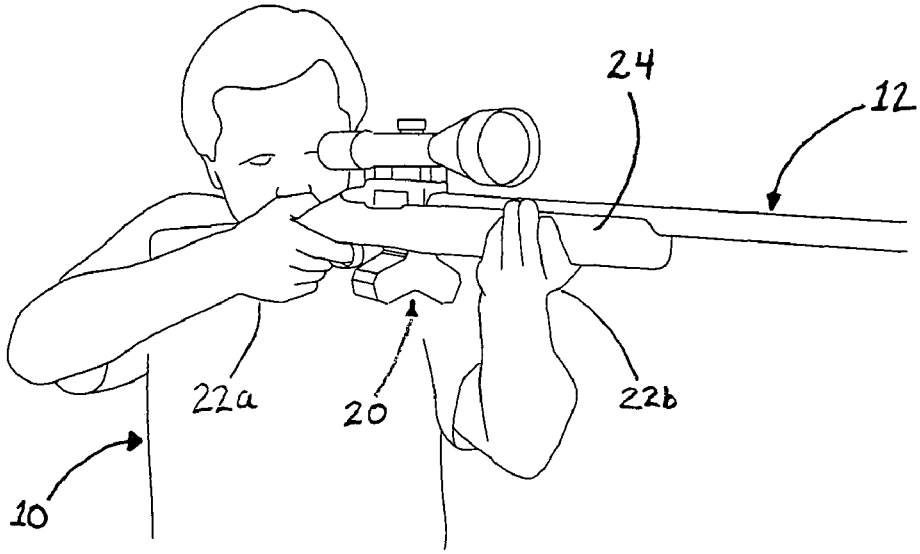
FIG. 1 is a perspective, environmental view of a shooter holding an exemplary semiautomatic .22 caliber rifle having a magazine assembly in accordance with the present invention installed therein.

FIG. 1 shows a shooter 10 holding an exemplary, non-limiting rifle 12, in this case a Ruger 10/22™ semiautomatic .22 rimfire rifle of the type described above. As can be seen, a multi-magazine assembly 20 in accordance with a preferred embodiment of the present invention in accordance with a preferred embodiment of the present invention is employed by inserting one of the magazines in the assembly into the standard, unmodified magazine well of the rifle. The other, non-inserted magazines of the assembly depend from the rifle to a limited extent, however, it can be seen that the protrusion is minimal and that the shooter's hands 22*a*, 22*b* are free to grip and handle the stock 24 of the rifle in an unobstructed manner. Moreover, since the principal components of the assembly are preferably constructed of strong yet lightweight plastic, the weight of the complete assembly is not excessive and handling the rifle consequently remains substantially unencumbered.

As used in this description and the appended claims, the terms "forward", "rearward", "upper", "lower" and so on refer to the orientation of various parts as the gun is held for normal use, as shown in FIG. 1, e.g., "forward" is towards the muzzle, "rearward" towards the butt, and so on.

Figure 2:
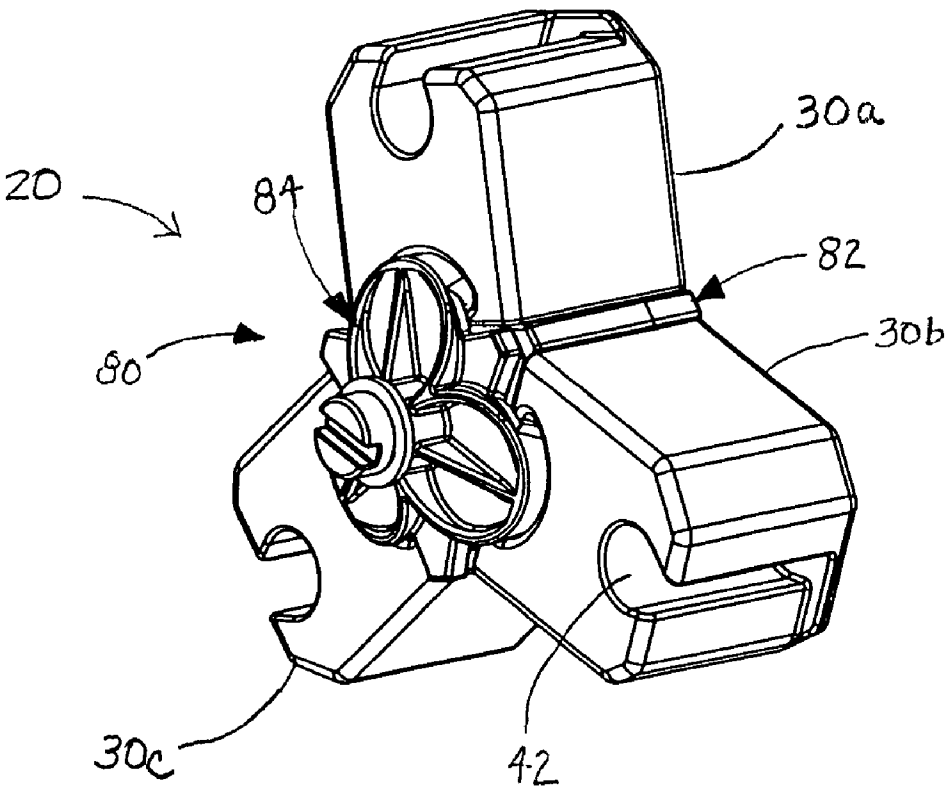
FIG. 2 is a perspective view of the multi-magazine assembly of FIG. 1, showing the manner in which a plurality of original equipment-type magazines are joined together by a connector block and coupling plate to form a rigid, stable assembly.

FIG. 2 shows the multiple magazines assembly 20 in enlarged detail, removed from the magazine well of the rifle. As can be seen, the assembly includes a plurality of individual, original equipment-type rotary magazines 30; in the preferred embodiment that is illustrated, the assembly includes three OEM-type magazines 30*a-c* mounted in a triangular configuration, however, it will be understood that other embodiments may be configured for a greater or lower number of the magazines.

Figure 3A:
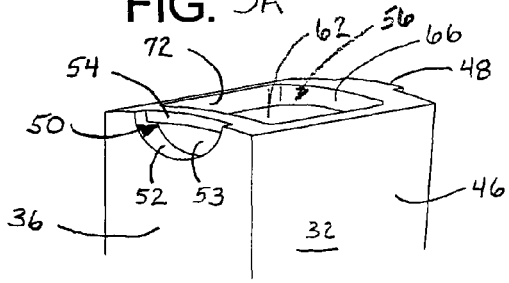
FIG. 3A is a partial, perspective view of a base portion of one of the individual magazines of FIGS. 1-2, with the magazine being inverted to show details of the base portion of the magazine and the recess therein in greater detail.
Figure 3B:
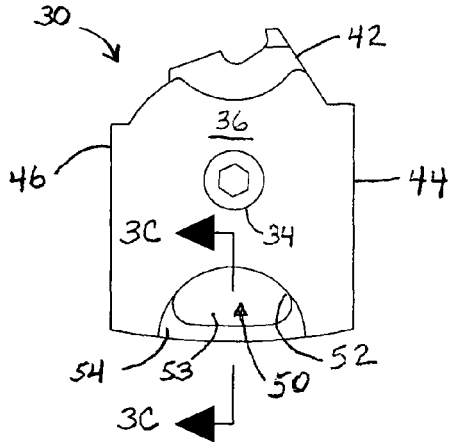
FIG. 3B is an end elevational view of the individual magazine of FIG. 3A, with the magazine oriented to have its base portion at the bottom of the view.
Figure 3C:
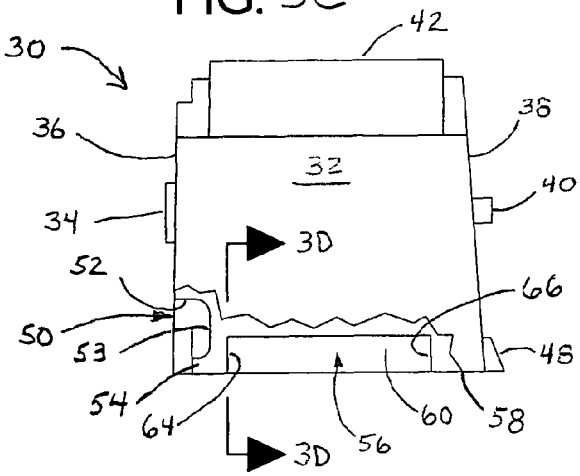
FIG. 3C is a side-elevational view of the individual magazine of FIGS. 3A-3B, partially cutaway along line 3C-3C to show the structure of the recess at the base of the magazine in greater detail.
Figure 3D:
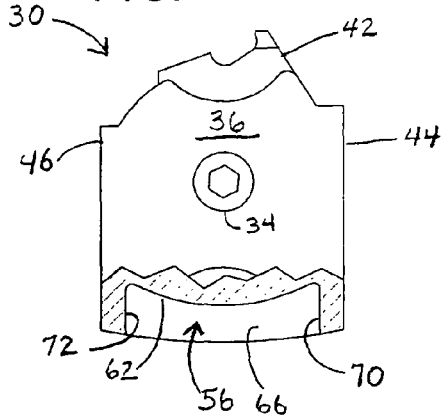
FIG. 3D is an end elevational view, similar to FIG. 3B, of the individual magazine of FIGS. 3A-3C, partially cutaway along line 3D-3D in FIG. 3C so as to show the configuration of the base recess in greater detail.

FIGS. 3A-3C illustrate the configuration of the rotary-type magazines 30 in greater detail. As was described above, the original equipment-type magazines, as utilized by the Ruger 10/22™ rifle and others, are generally supplied by the original manufacturer of the rifle, and therefore are themselves not a part of the invention. However, the components of the connector assembly of the present invention engage and cooperate with the various features of the magazines to form the multiple magazine assembly, consequently the following description of an original equipment-type magazine (e.g., Ruger part number 90005) is provided to give a better understanding of the function and use of the present invention.

As can be seen in FIGS. 3A-3C, the original equipment-style magazine 30 includes a somewhat rectangular, block-shaped shell 32 that encloses the rotary drum (not shown) for storing and feeding the .22 ammunition. A shaft 34 for the spring-loaded rotary mechanism is supported in the front and rear end walls 36, 38 of the shell, with the end 40 of the shaft protruding at the latter. A throat piece 42 provides the passage through which rounds of the ammunition are fed into/out of the magazine, with rounds being rotated to and from the throat piece by the drum mechanism. The sides of the shell unit are formed by generally flat, left and right sidewalls 44, 46. A projecting tang or tab 48 is formed at the foot of the rear wall 38, which cooperates with a catch to retain the clip in the magazine well of the rifle. On the opposite side recess 50 is formed at the bottom of the forward wall 36 by a concave inlet 52, and is partially closed at the bottom by a transverse, forwardly-projecting lip or ledge 54. Furthermore, as can be seen in FIG. 3C, an upwardly extending recess 56 is formed more-or-less centrally in the bottom surface 58 of the clip by an upward concavity 53, through which the convex lower wall 62 surrounding the cylindrical drum mechanism is exposed. The recess 56 is roughly rectangular in plan view and is bordered on four sides by front and rear walls 62, 64 and side walls 70, 72, all of which are spaced inwardly from the corresponding end and side walls 36, 38, 44, 46 of the shell 32. The shell of the rotary magazine is generally formed of tough molded plastic. As was noted above, the original equipment-type rotary magazine is not itself part of the present invention and the description thereof is provided for a better understanding of the present invention rather than being limiting thereon.

Now, referring again to FIG. 2, it can be seen that the connector assembly 80 of a preferred embodiment of the present invention, that joins together the individual magazine described above to form the assembly 20 of FIG. 1, includes two principal members, namely a connector block 82 that engages the base recesses of the individual magazines 30*a-c*, and a coupling plate 84 that engages the forward recesses of the magazines so as to hold the latter together against the connector block. As can better be seen in the exploded view of FIG. 4, the connector block 82 has a plurality of mounting faces 86, in the illustrated embodiment there being three radially-spaced mounting faces 86*a-c* joined in a triangular configuration at corners 88. Each mounting face is configured to receive one of the individual magazines 30, and includes a pair of projecting, longitudinal extending locating ribs 90*a*, 90*b* that are configured to be received in and engage the lower recess of the magazine. A tubular sleeve 92 defines a longitudinally extending bore 94 through the connector block, with the tubular sleeve being supported centrally within the block by radial struts 96 that extend between it and the mounting faces 86*a-c*. At its rearward end the bore 94 opens up to a hex-shaped socket that cooperatively receives a hex-shaped threaded nut 98 so as to hold the latter against rotation relative to the connector block.

As will be described in greater detail below, the mounting faces of the connector block, including the locating ribs, are configured to engage the inside wall surfaces of recesses 56, so as to locate the individual magazine, and hold the position against both transverse (side-to-side) and longitudinal (rearward) movement. End plate 84, in turn, engages the recesses 50 in the forward sides of the magazines to hold each magazine against movement in an outward (radial) direction relative to the connector block.

Figure 4:
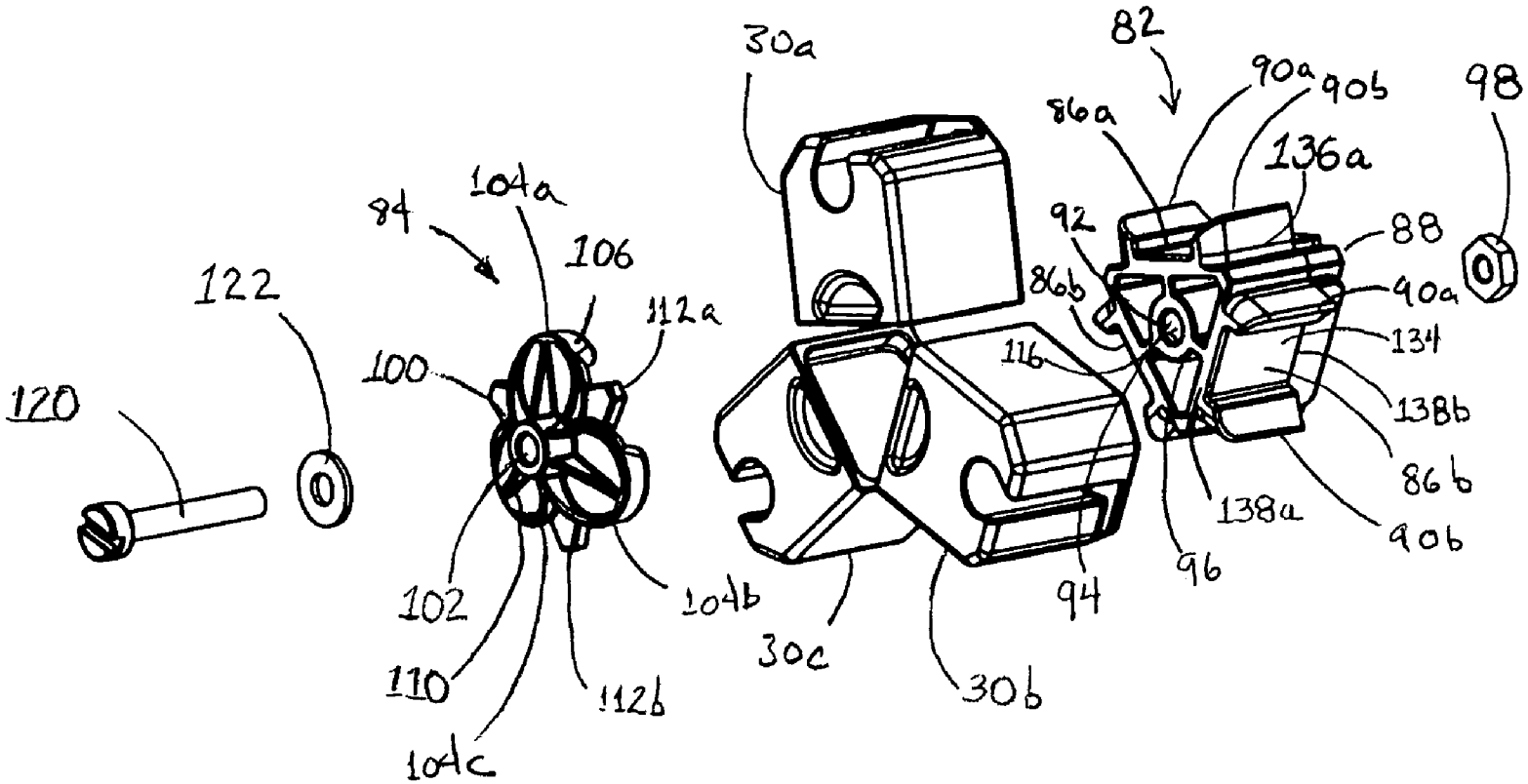
FIG. 4 is an exploded, perspective view of the multiple magazine assembly of FIGS. 1-2, showing the components in greater detail and also the manner in which the features of the connector block and coupling plate engage cooperating features on the original equipment-type magazines to join the latter together in the assembly.

As can be seen with reference to FIG. 4, the coupling plate 84 includes a central tubular sleeve 100 having a bore 102 coaxially aligned with that of the connector block 82, with three connector flanges 104 extending radially therefrom in spaced positions corresponding to those of the mounting faces on the connector block. A rearwardly projecting retaining tab 106 is formed at the outer/distal end of each connector flange, and is sized and configured to be received in one of the forwardly facing recesses 50 of the individual magazines 30 so as to fit over and engage the lower shelf/lip 54 therein. The forward faces of the connector flanges (i.e., the faces opposite the magazine 30) are strengthened by perimeter ridges 108 and by gussets 110 that extend between the flanges and a hub formed by the forwardly-projecting portion of sleeve 100. A corresponding number (three) of radially projecting, secondary flanges 112*a-c* are located intermediate the main connector flanges 104*a-c* and serve to both stabilize the connector flanges and to block the magazines from rotating/twisting on the connector flanges.

The coupling plate 84 further includes a rearwardly projecting hub formed by a portion of tubular sleeve 100, that engages the forward end 116 of the tubular sleeve of the connector block when the pieces are assembled. With the sleeves coaxially aligned, a screw 120 (e.g., a machine or cap screw) is passed through the coupling plate and connector block and is threaded into the nut 98 on the rearward side of the latter, a washer 122 being positioned between the front hub of the coupling plate and the head of the screw to facilitate tightening of the latter.

The connector block 82 and coupling plate 84 are suitably formed of high strength molded plastic material, such as fiber-filled nylon, although it will be understood that various other plastics or non-plastic materials may be used. Similarly, the screw, washer and nut are suitably formed of steel or other metal, but in some embodiments plastic or other non-metallic materials may be used.

Figure 5:
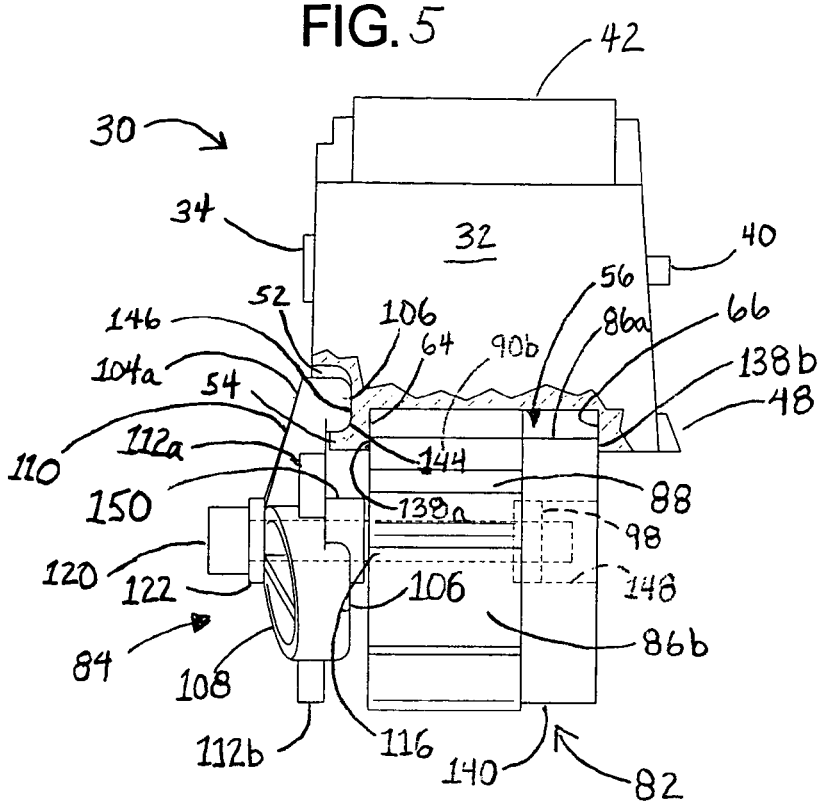
FIG. 5 is a side elevational view of one of the individual magazines and the connector assembly of FIGS. 1-2, with the base of the clip being shown partially cutaway similar to FIG. 3C, showing the manner in which the connector block and coupling plate cooperatingly engage the recesses in the base and forward side of the magazine to hold the latter in the assembly.
Figure 6:
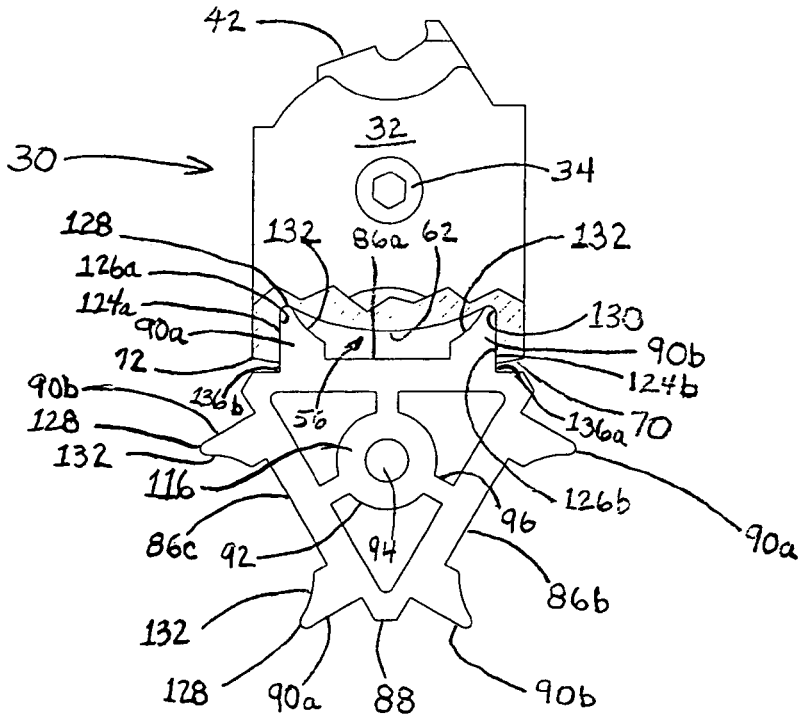
FIG. 6 is an end elevational view of the connector block and individual magazine of FIG. 5, with the magazine being partially cutaway similar to FIG. 3D, showing the manner in which the locating ribs of the connector block cooperate with the inside surfaces of walls of the base recess to locate the magazine on the mounting face of the block.

The engagement established between the connector block and coupling plate and the individual magazines is shown in greater detail in FIGS. 5-6.

As can be seen in FIG. 5, when an individual magazine is placed against one of the mounting faces (face 86*a* in the illustrated example), the locating ribs 90*a*, 90*b* at the sides of the mounting face enter the recess 56 in the base of the clip, so that the tops of the magazine and throat piece 42 project outwardly therefrom for insertion in the firearm. As can best be seen in FIG. 6, outwardly facing surfaces 124*a*, 124*b* of the locating ribs are spaced apart laterally by a distance that is about equal to or just slightly less than the inside distance between the sidewalls 70, 72 of the recess, so that the outer surfaces 126*a*, 126*b* of the ribs establish a stable, but detachable, sliding interfit between the connector block and the magazine. Penetration of the locating ribs into the recess 56 is limited by contact between the upper edges 128 of the ribs with the inside corners 130 at the edges of the recess, the faces 132 on the inside edges of the ribs being concavely contoured to provide clearance for the convex lower surface 62 of the drum housing. As can best be seen in FIG. 6, the upper edges 128 of the ribs are preferably contoured so as to seat within the channel-shaped inside corners 130 of the recess 56, so as to form elongate, longitudinal contact areas that stabilize the interfit of the pieces.

As can be seen with further reference to FIG. 6 and also FIG. 4, each of the mounting faces 56 also includes a raised, plug-shaped base portion 134 having a generally square or rectangular configuration 56, corresponding to that of the base recesses 56, with side wall surfaces 136*a-b* (continuous with the outside surfaces of the locating ribs 90*a-b*) and end wall surface 138*a-b* bordering the base so as to fit closely within the corresponding side and end walls 70, 72, 64, 66 of the recesses. Thus, as the locating ribs are pressed home, the plug-shaped base portion 134 enters the recess so that the foregoing surfaces come into front-to-rear and side-to-side abutment.

The engagement of the outer surfaces of the mounting face (including the locating ribs) with those of the recess 56 hold the magazine against both longitudinal and lateral movement relative to the connector block. As a group, therefore, the ribs and other features of the mounting faces 56 serve to locate the individual magazines in stationary positions relative to the connector block, with the bases of the magazines positioned against the block and the feed ends of the magazines facing outwardly therefrom. The coupling plate 84, in turn, serves principally as a retainer to releasably hold the magazines in their stationary positions and prevent them separating from the connector block.

As can be seen in FIG. 2 and also FIG. 5, the radial, somewhat leaf-shaped connector flanges 104*a-c* are configured to fit within the generally semi-circular cutouts 52 at the forward ends of the magazines, with the retaining tabs 106 projecting rearwardly therefrom so as to enter recesses 50 a sufficient depth to be positioned above the forwardly projecting shelves or ledges 54 in the lower portions thereof; as can be seen in FIG. 5, the spacing between the axis of the assembly and the lower surfaces of the retaining tabs 106, relative to the spacing between the axis and the upper edges 128 of the locating ribs 144, is such that the lower surfaces of the retaining tabs will bear against the upper surfaces of the projecting ledges 45 when the magazines are installed on the mounting faces and the tabs are pushed home into the recesses. Furthermore, as can be seen in FIG. 5, the lower surfaces 144 of the connector tabs are preferably convexly curved so as to fit within and generally conform to the concavely curved surfaces 146 of the recesses over the ledges 54, so that the surfaces will cooperate to draw the magazines downwardly against the mounting faces as the coupling plate 84 is tightened against the connector block.

For ease of illustration, FIGS. 5 and 6 show only a single magazine 30 mounted on the connector assembly, although it will be understood that, there will generally be a complete set (e.g., three) of magazines connected together in the assembly (although fewer may be used if desired).

In an exemplary sequence for forming the multi-magazine assembly, the machine screw 120 is first inserted through the washer 122 and the bore in coupling plate 84, and then passed through the bore 94 of the coupling block and threaded into the nut 98 that is retained in the hexagonal recess 148 on the rearward end of the block. With the screw 120 kept sufficiently loose to provide clearance to allow the ledge portions 54 of the magazines to pass under the retaining tabs 106, the individual magazines 30 are placed against the mounting faces 6*a-c* so that the locating ribs thereon enter recesses 56 to position the clips in the manner described above. As can be seen with reference to FIG. 5, the projecting ribs 90*a*, 90*b* are preferably somewhat shorter in length than the length of the recess, leaving the rearward portion of the mounting free of the projecting ribs, which eases initial insertion of the ribs, after which the ribs can be slid to the front of the recess 56 so as to align the recess with the base plug 134; for example, in the embodiment that is illustrated, the locating ribs 90*a*, 90*b* suitably have a length equal to about two-thirds that of the recess 56.

Once in place on the connector block, the array of clips is held together temporarily, for example, by the fingers of the user's off hand or by a rubber band, string or other aid, and the screw 120 is tightened so as to force the retaining tabs 106 into the end recesses 50. Further tightening (e.g., with a screwdriver or allen wrench) drives the retaining tabs firmly into the recesses so that they press tightly over the ledges 54 and also force the forward wall 64 of the recess hard against the front surfaces of the locating ribs and plug-shaped base 134, creating a rigid and stable assembly in which the individual magazines are held firmly in place. A rearwardly projecting portion of the axial sleeve of the coupling plate forms a hub

150 that bears against the front of the sleeve 92 of the connector block so as to prevent further over-tightening and potential distortion of the assembly. The generally triangular intermediate flange portions 112*a-c*, in turn, fit into the gaps between the corners of adjacent magazines so as to block and prevent twisting/turning of the magazines on the connector flanges.

In the event that an individual magazine becomes damaged or otherwise nonfunctional, or should the shooter simply wish to use one or more of the magazines separate from the assembly, the screw 120 can be loosened so as to move the coupling plate outwardly from the connector block by a distance to withdraw the retaining tabs from recesses 50, thus releasing the magazines so that one or more can be removed as desired. A substitute or the same magazine or magazines can subsequently be inserted in the assembly if desired and the screw retightened in the manner described above.

The radial array of magazines formed in the illustrated embodiment has the advantage of compactness while providing adequate clearance beneath the rifle for the non-inserted magazines, and also allows magazines to be charged with a simple turn of the wrist. It will be understood, however, that non-radial configurations may be used in some embodiments such as a "T-" or "H-" shaped configuration for example. It will also be understood that the basic two-piece, plus adjusting screw, mechanism of the illustrated embodiment provides significant advantages in terms of simplicity, low cost and durability, however some embodiments may utilize spring-loaded, articulated or elastomeric mechanisms, for example, in place of or in addition to the adjustable screw mechanism to move the cooperating members together and apart to capture and release the magazines.

It is therefore to be recognized that various alterations, modifications, and/or additions may be introduced into the constructions and arrangements of parts described above without departing from the spirit or ambit of the present invention as defined by the appended claims.

What is claimed is:

1. An apparatus for joining together a plurality of individual ammunition magazines to form a multiple magazine assembly in which said individual magazines are alternately insertable into a firearm, said individual magazines each having a base recess in a lower end and a forward side thereof, said apparatus comprising:

a connector member having a plurality of mounting portions each of said mounting portions having at least one locating feature that is detachably receivable in a base recess of said individual magazines;

a coupling member having a plurality of connector portions, each of said connector portions having at least one retaining feature that is detachably receivable in a forward recess of said individual magazines; and means for selectively inserting said connector portions of said coupling member into said forward recesses of said individual magazines with said magazines received on said mounting portions so as to detachably retain said individual magazines on said connector member to form said multiple magazine assembly.

2. The apparatus of claim 1, wherein said at least one locating feature of each of said mounting portions of said connector member comprises:

first and second outside wall surfaces spaced apart laterally so as to fit within and engage first and second side wall surfaces of said base recesses of said individual magazines so as to hold said magazines against lateral movement relative to said connector member.

3. The apparatus of claim 2, wherein said at least one locating feature of each of said mounting portions of said connector member further comprises:

forward and rearward outside wall surfaces spaced apart longitudinally so as to fit within and engage forward and rear surfaces of said base recesses of said individual magazines so as to hold said magazines against longitudinal movement relative to said connector member.

4. The apparatus of claim 3, wherein said at least one locating feature further comprises:

first and second locating ribs projecting at said mounting location, said first and second locating ribs having said outside wall surfaces formed on outwardly-facing sides thereof.

5. The apparatus of claim 3, wherein said at least one retaining feature of said connector portions of said coupling member comprises:

a retaining tab that projects from said connector portion so as to extend into said forward recess of said individual magazine to a position above a forwardly projecting ledge portion located therein.

6. The apparatus of claim 5, wherein said connector member comprises:

a connector block having said plurality of mounting positions at spaced locations about sides thereof.

7. The apparatus of claim 6, wherein said coupling member comprises an end plate mounted to a forward end of said connector block.

8. The apparatus of claim 7, wherein said mounting portions are at radially spaced locations about said sides of said connector block.

9. The apparatus of claim 8, wherein there are three of said mounting portions at radially-spaced locations about said connector block, for holding three of said individual magazines in said multiple-magazine assembly.

10. The apparatus of claim 8, wherein said connecting portions of said coupling member comprise:

radially-extending flange portions of said coupling plate, each of said flange portions having a retaining tab located proximate an outer end thereof.

11. The apparatus of claim 10, wherein said means for selectively inserting said connector portions of said coupling member into said forward recesses of said individual magazines comprises:

coaxially aligned bores formed in said connector block and said coupling plate; and a screw member received in said coaxially aligned bores so that in response to tightening of said screw member said coupling plate having said connector portions thereon is moved towards said connector block having said mounting portions thereon.

12. An apparatus for joining together a plurality of individual ammunition magazines to form a multiple magazine assembly in which said individual magazines are alternately insertable into a firearm, said individual magazines having a base end with an upwardly-extending recess and a forward side with a rearwardly extending recess and a ledge portion located therein, said apparatus comprising:

a connector block having forward and rearward ends and a perimeter;

a plurality of mounting faces formed at spaced locations about said perimeter of said connector block, each said mounting face having at least one locating position projecting outwardly therefrom that is slidingly receivable in said upwardly extending recess in said base of one of said individual magazines so as to hold said magazine against longitudinal and lateral movement relative to said connector block;

a coupling plate mounted to said forward end of said connector block, said coupling plate having forward and rearward ends and a perimeter;

a plurality of connector portions formed at spaced locations about said perimeter of said coupling plate, each said connector portion having at least one retaining tab projecting rearwardly therefrom that is slidingly receivable in said rearwardly extending recess in said forward side of one of said individual magazine members over said ledge portion therein so as to releasably hold said magazine against outward movement relative to said coupling plate; and means for translating said coupling plate from a forward position in which said coupling plate is spaced from said mounting block so that said retaining tabs thereon are withdrawn from said recesses in said forward sides of said individual magazines so as to allow said magazines to be removed from or placed on said mounting faces, to a rearward position in which said coupling plate is located proximate said mounting block so that said retaining tabs thereon are inserted into said recesses in said forward sides of said magazines so as to secure said individual magazines in place on said mounting faces.

13. The apparatus of claim 12, wherein said means for translating said coupling plate between said forward and rearward positions comprises:

an adjustment screw operatively connecting said coupling plate to said attachment block.

14. The apparatus of claim 12, wherein said upwardly extending recesses in said base portions of said individual magazines have front and rear walls and first and second side walls, and wherein said at least one locating portion projecting outwardly from each of said mounting faces of said connector block comprises:

a raised base portion that is slidingly receivable in said upwardly extending recesses in said base ends of said individual magazines, said base portion having front, rear and side walls spaced apart so as to form a slidingly interfit with said front and rear end walls and first and second side walls of said recess.

15. The apparatus of claim 14, wherein said at least one locating portion projecting outwardly from each of said mounting faces of said connector block further comprises:

first and second substantially parallel locating ribs extending longitudinally proximate first and second side edges of said mounting face, said locating ribs having outward side faces that are spaced apart so as to slidingly engage inside surfaces of said first and second sidewalls of said upwardly extending recesses in said base ends of said individual magazines.

16. The apparatus of claim 12, wherein said plurality of mounting faces and connector portions are spaced radially about said connector block and said coupling plate.

17. An apparatus for joining together a plurality of individual ammunition magazines to form a multiple magazine assembly in which said individual magazines are alternately insertable into a firearm, said individual magazines each having a base end with an upwardly extending recess with front and rear wells and first and second side walls, and a forward side with a rearwardly extending recess having a forwardly projecting ledge portion located therein, said apparatus comprising:

a connector member, comprising:

a connector block having forward and rearward ends and a perimeter;

an axial bore extending between said forward and rearward ends of said connector block; and a plurality of outwardly directed mounting faces formed at radially spaced locations about said perimeter of said connector block, each of said mounting faces comprising:

a raised base portion that is slidingly receivable in said upwardly extending recesses in said base ends of said individual magazines, said base portion having front, rear and side walls spaced apart so as to form a slidingly interfit with said front and rear end walls and first and second side walls of said recess; and first and second substantially parallel locating ridges projecting outwardly proximate longitudinal side edges of said mounting face for being received in said upwardly extending recess in said base of one of said individual magazines, said locating ridges having outside surfaces that are spaced apart so as to form an interfit with said side walls of said recess so as to hold said individual magazine against moving laterally on said mounting face;

a coupling member, comprising:

an end plate mounted at said forward end of said connector block and having forward and rearward ends and a perimeter;

an axial bore extending between said forward and rearward ends of said end plate in coaxial alignment with said axial bore of said connector block; and a plurality of connector portions formed at radially spaced locations about said perimeter of said end plate that corresponds to said locations of said mounting faces of said connector block, each of said connector portions comprising:

a connector flange extending outwardly from said axial bore; and a retaining tab projecting rearwardly proximate an outer end of said connector flange for being received in said rearwardly extending recess in said forward side of one of said individual magazines, said retaining tab having a lower surface that forms an interfit with an upper surface of said ledge portion of said rearwardly extending recess so as to hold said individual magazine from moving outwardly relative to said connector portion; and an adjustment screw received in said coaxially aligned bores of said connector block and said end plate, said adjustment screw being selectively adjustable to translate said end plate between a forward position in which said coupling plate is spaced from said connector block so that said retaining tabs thereon are withdrawn from said recesses in said forward sides of said individual magazines so as to allow said magazines to be removed from or placed on said mounting faces, to a rearward position in which said coupling plate is located proximate said connector block so that said retaining tabs thereon are inserted into said recesses in said forward sides of said individual magazines so as to secure said individual magazines in place on said mounting faces of said connector block.

18. The apparatus of claim 17, wherein there are three mounting faces and three connector portions, at equidistant radial spacing about said perimeters of said connector block and said end plate.

* * * * *